United States Patent [19]

Chiesa, Jr.

[11] 4,060,132

[45] Nov. 29, 1977

[54] FIRE FIGHTING WITH THIXOTROPIC FOAM

[75] Inventor: Peter J. Chiesa, Jr., Coatesville, Pa.

[73] Assignee: Philadelphia Suburban Corporation, Bryn Mawr, Pa.

[21] Appl. No.: 557,757

[22] Filed: Mar. 12, 1975

Related U.S. Application Data

[63] Continuation-in-part of Ser. No. 525,175, Nov. 19, 1974, Ser. No. 369,584, June 13, 1973, Pat. No. 3,957,657, and Ser. No. 307,479, Nov. 17, 1972, abandoned, said Ser. No. 525,175 is a continuation-in-part of said Ser. No. 369,584, said Ser. No. 307,479, and Ser. No. 254,404, May 18, 1972, Pat. No. 3,849,315, said Ser. No. 369,584 is a continuation-in-part of said Ser. No. 307,479, said Ser. No. 254,404, and Ser. No. 131,763, Apr. 6, 1971, abandoned, said Ser. No. 307,479, is a continuation-in-part of said Ser. No. 254,404 and said Ser. No. 131,763, said Ser. No. 254,404 is a continuation-in-part of said Ser. No. 131,763. This application Mar. 12, 1975, Ser. No. 557,757

[51] Int. Cl.[2] ..... A62D 1/00

[52] U.S. Cl. ..... 169/47; 169/46; 252/3; 252/6.5; 252/8.05; 252/307; 252/316

[58] Field of Search ..... 252/8.05, 316, 307, 252/6.5, 3; 260/209 R, 210 R; 169/46, 47

[56] References Cited

U.S. PATENT DOCUMENTS

| | | | |
|---|---|---|---|
| 2,514,310 | 7/1950 | Busse et al. | 252/3 |
| 2,529,211 | 11/1950 | Busse et al. | 252/8.05 |
| 3,301,848 | 1/1967 | Halleck | 260/209 R |
| 3,334,052 | 8/1967 | Kurz et al. | 252/316 |
| 3,383,307 | 5/1968 | Goetz | 252/316 |
| 3,480,546 | 11/1969 | Bashaw et al. | 252/3 |
| 3,557,016 | 1/1971 | Schuppner, Jr. | 252/316 |
| 3,562,156 | 2/1972 | Francen | 252/3 |
| 3,562,176 | 2/1971 | Stancioff et al. | 260/209 R |
| 3,619,842 | 11/1971 | Maierson | 252/316 |
| 3,677,347 | 7/1972 | Rosen et al. | 252/3 |
| 3,741,805 | 6/1973 | Crotty et al. | 252/316 |
| 3,849,315 | 11/1974 | Chiesa, Jr. | 252/3 |
| 3,957,657 | 5/1976 | Chiesa, Jr. | 252/3 |
| 3,957,658 | 5/1976 | Chiesa, Jr. et al. | 252/3 |

*Primary Examiner*—Benjamin R. Padgett
*Assistant Examiner*—T. S. Gron
*Attorney, Agent, or Firm*—Connolly and Hutz

[57] ABSTRACT

Aqueous foam formed with a solution containing a thixotropic polysaccharide in addition to foaming agent, will gel when projected onto a burning hydrophilic liquid, and such foam is not destroyed by the liquid, so that it is suitable to fight fires on hydrophilic liquids as well as on hydrophobic liquids and on solids that are compatible with the foam. The thixotropic character enables the ready pumping of the foam and of the solution from which it is formed. A substantial content of N-methyl pyrrolidone-2 in a concentrate for such foam-producing solution makes such concentrate more adaptable for ready dilution and also improves its stability. Other ingredients can also be included such as to form films over hydrophobic liquids to improve the stability of the foam that is formed and to increase the thixotropic action.

4 Claims, No Drawings

FIRE FIGHTING WITH THIXOTROPIC FOAM

This application is a continuation-in-part of applications Ser. No. 525,175 filed Nov. 19, 1974, Ser. No. 369,584 filed June 13, 1973 U.S. Pat. No. 3,957,657 granted May 18, 1976), and Ser. No. 307,479 filed Nov. 17, 1972 (subsequently abandoned. Application Ser. No. 525,175 is in turn a continuation-in-part of applications Ser. No. 369,584 and Ser. No. 307,479, as well as of application Ser. No. 254,404 filed May 18, 1972 (U.S. Pat. No. 3,849,315 granted Nov. 19, 1974), while application Ser. No. 369,584 is also a continuation-in-part of applications Ser. No. 307,479, Ser. No. 254,404 and Ser. No. 131,763 filed Apr. 6, 1971 (subsequently abandoned); and Ser. No. 307,479 is itself a continuation-in-part of Ser. No. 254,404 and Ser. No. 131,763. In addition application Ser. No. 254,404 is a continuation-in-part of Ser. No. 131,763.

The present invention relates to the fighting of fires with foam produced by diluting with water and foaming with air a concentrate that can be conveniently kept stored until ready for use.

Among the objects of the present invention is the provision of novel concentrates of the foregoing type as well as novel foamable mixtures and ingredients thereof. Additional objects include novel fire-fighting processes that make use of the foregoing materials.

These as well as further objects of the present invention will be better understood from the following description of several of its exemplifications.

The fighting of fires on burning solids and burning hydrophobic liquid has reached a highly advanced state, and fire-fighting materials for these purposes are relatively inexpensive as well as readily storable and easily used. However the fighting of fires on hydrophilic liquids has called for more expensive and cumbersome fire-fighting materials.

According to the present invention a foamable composition very effective for fighting fires on all liquids including hydrophilic liquids, is essentially an aqueous solution of (1) a foam-forming material that causes the solution to form a foam having an expansion of at least about 3, and (2) a thixotropic material that causes the solution to gel in the absence of shear. There can also be dissolved in the solution foam-stabilizing solid hydrophilic resin and/or filming material that causes an aqueous film to form over hydrophobic liquids when the solution is used to fight a fire on such a liquid. Whether or not the solution contains such filming material or the hydrophilic resin, it produces a foam highly suited to fight fires on any liquid and even on solids compatible with aqueous foam, so that it is an almost universal type of fire-fighting composition. Moreover the solution is readily made from a single concentrate which can be diluted with many times its volume of water so that storing and using such a concentrate are relatively simple matters. Such concentrates are also quite stable and can be stored for years without significant deterioration.

EXAMPLE I

A preferred concentrate pursuant to the present invention has the following formulation:

-continued

| | |
|---|---|
| $(CF_3)_2CF(CF_2)_nCOO^- + NH_3C_2H_5$ where 20% of the n is 2, 30% of the n is 4, 30% of the n is 6, and 20% of the n is 8 | 2040 grams<br>4710 ml |
| 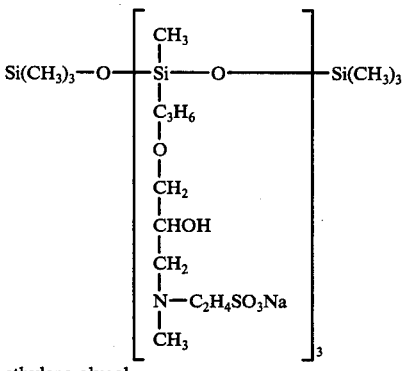 | |
| ethylene glycol | 9600 ml |
| 10% by weight aqueous solution of the reaction product of 3-dimethylamino-propylamine-1 with an equivalent amount of ethylene-maleic-anhydride copolymer, per Example I in the specification of U.S. Pat. App. Ser. No. 131,763 filed April 6, 1971, now abandoned, (also in British counterpart specification 1,381,953) | 11,800 ml |
| 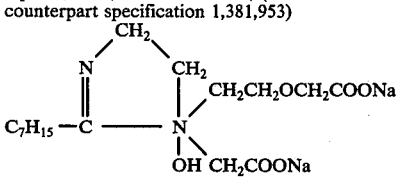 | |
| (27% by weight in water) | 10,800 ml |
| water | 1800 ml |
| scleroglucan (U.S. Pat. No. 3,301,848) | 1540 g |
| 10% aqueous solution of equimolecular mixture of sodium decyl sulfate and sodium octyl sulfate | 13,920 ml |
| N-methyl pyrrolidone-2 | 53,520 ml |

The first of the listed ingredients is dissolved in some of the N-methyl pyrrolidone-2 to make about a 60% solution, and then mixed with the next five ingredients in a 55 gallon container, after which the scleroglucan is added portionwise with good stirring and pumped through a recirculating pump until that mixture is smooth. The remaining ingredients are then added and the resulting mixture mixed thoroughly. A total mixing time of 4 hours may be used, and the final product is a highly thixotropic material that on standing unagitated rapidly becomes a thick gel. However with a bit of stirring it flows fairly easily. Under the influence of a suction of several inches of mercury produced at the intake of a venturi jet, the thick gel also flows smoothly up into such a suction intake.

The foregoing formulation is also slightly alkaline. For avoiding putrefaction during storage preservative such as methyl parahydroxybenzoate, propyl parahydroxybenzoate, formaldehyde, phenol or chlorinated metaxylenol can be added to the mixture in an amount about 0.01% by weight.

When the foregoing concentrate is diluted with 10 times its volume of water it is readily foamed with air to produce a very effective fire-fighting foam having an expansion of 6 to 8. When foamed with the apparatus of U.S. Pat. No. 2,868,301 the foam can be projected a substantial distance. Projected onto a burning liquid as hydrophilic as ethanol or acetone, the foam thus applied is not broken, but instead forms a gel-like mat that does not dissolve in such liquid rapidly enough to significantly diminish the spreading of the projected foam over the burning surface and the extinguishing of the fire by the foam. The formation of the mat involves gelation of the liquid in the foam and loss of solvent from the gelled liquid through syneresis, and takes place so rapidly that the foam bubbles are trapped in the mat so that it floats on the liquid. This action takes place with about equal effectiveness when the diluting water is tap water or sea water or any combination of these two waters, and resulting diluates have about the same fire-fighting effectiveness Also when used to fight fires on hydrophobic liquids, the foregoing foams show the same good results as the foams of application Ser. No. 131,763 (or its above-noted British counterpart).

Any other water-soluble fluorocarbon surfactant having a perfluorinated terminal group of about 6 to about 15 carbons, such as a water-soluble fluoroalcohol or the water-soluble fluorocarbon surfactants of the above-mentioned prior applications (U.S. and British) and of U.S. Pat. Nos. 3,475,333, 3,655,555 and 3,562,156, and particularly amphoteric surfactant having the foregoing terminal perfluorinated group, can be used in place of the fluorocarbon surfactant mixture listed in Example I, as can such fluorocarbon surfactants in which the terminal group is one fluorine shy of being perfluorinated. Likewise any other silicone surfactant including the silicone surfactants of the aforesaid prior applications can be used in place of the silicone surfactant listed above. Indeed either or both of these ingredients can be omitted, in which event the resulting simplified formulation is just as effective in extinguishing fires on hydrophilic liquids as well as fires on solid materials, but is somewhat slower to extinguish fires on hydrophobic liquids and does not seal such hydrophobic liquids as well against reignition. When the fluorocarbon and silicone surfactants are used they should be in proportions that reduce the surface tension of the diluted concentrate to 19 dynes or less per centimeter, preferably 18 dynes or less per centimeter. For a tenfold dilution this translates to an economically feasible concentrate content of about 1 to 4 weight percent for the fluorocarbon surfactant and about 2 to 6 weight percent for the silicone surfactant. Smaller amounts can be used but their effectiveness may then not be worth their expense.

The ethylene glycol in the foregoing formulation can also be omitted, but its presence helps stabilize the foam produced from it and also increases the degree of gelling provided by the scleroglucan which is the thixotropic ingredient. If the ethylene glycol is replaced by an equal volume of water then the scleroglucan concentration is preferably increased 10% or the dilution before foaming reduced from 10 times to 9 times. Other glycols such as propylene glycol, hexylene glycol, diethylene glycol or glycerol can be used in place of the ethylene glycol. Where a glycol is used it is best used in an amount of from about 5 to 10% by weight in the concentrate to give about 0.5 to about 1% by weight when diluted and foamed.

The foam-stabilizing hydrophilic resin which is the fourth of the above-listed ingredients can also be omitted but its presence in the diluted liquid to the extent of 0.05 to 0.2% by weight (0.5 to 2% by weight of the concentrate) is of great help in fire-fighting inasmuch as it increases the effectiveness of the foam both in knocking down the fire and in sealing the surface of the liquid against reignition, regardless of the nature of that surface. However other hydrophilic foam-stabilizing resins including others disclosed in the prior specifications, can be used in its place with substantially the same effectiveness.

Another such resin is made from the ethylene-maleic anhydride polymer of Example VII in U.S. Pat. No. 2,378,629, using the same technique described in the designated prior specifications for reacting it with 3-dimethylamino propylamine-1.

A still further such resin is similar to those of the above formulations, but has styrene in place of the ethylene, as follows:

EXAMPLE II

The resinified product of Example 1 of U.S. Pat. No. 2,430,313, before treatment with caustic, is added to a 10% solution of 3-dimethylamino propylamine-1 in water until an equivalent amount of the resin is thus added. Most of the resin reacts with the amine and dissolves at room temperature, and the balance is caused to react by heating the mixture to 50° C for 3 hours. This crude product is ready for use and has a solids content of about 35%. In general the final amidated resin is a half amide that has the following repeating units.

| UNIT I (from styrene) | UNIT II (from maleic anhydride) |
|---|---|
| $-CH(\phi)-CH_2-$ | $-CH(C{=}O{-}OH)-CH(C{=}O{-}NH{-}C_3H_6{-}N(CH_3)_2)-$ |

and can have a molecular weight of 1500 to 150,000.

There can be about one-half to 5 phenyl ethylene (type I) units for every succinic (type II) acid unit, and it can be amidated with primary or secondary alkyl amines in which the alkyl has up to 5 carbons and can be substituted on any carbon, preferably an omega carbon, with amino and/or carboxyl groups. Such amino substitutent as well as the styrene and maleic acid precursors can also be substituted with alkyls having up to two carbons each. These resins have a polyaminoacid structure and are foaming agents in themselves, being suitable for replacing some or all of the protein hydrolyzate in protein hydrolyzate fire-fighting foam concentrates such as those described in U.S. Pat. No. 3,475,333 and in the article "Fire-Fighting Foams" by J. M. Perri, page 189 of "Foams-Theory and Industrial Applications" edited by J. J. Bikerman, Reinhold Publishing Corporation, New York 1953.

One specific formulation using such foam stabilization is:

EXAMPLE III

| | |
|---|---|
| The crude amidated styrene-maleic anhydride resin of Example II (30% by weight in water) | 3187 ml |
| Ferrous chloride 42% solution in water | 96 ml |
| Zinc chloride 50% solution in water | 64 ml |
| Ethylene glycol | 100 ml |
| Hexylene glycol | 320 ml |

This formulation is a very effective fire fighter. In a test using a tank having a 32 square foot horizontal cross-section, 20 gallons of automotive gasoline on a layer of water was ignited, and after 1 minute preburn 2 gallons per minute of the 1:33 diluted formulation foamed to an expansion of about 4 were applied with the following results:

| | |
|---|---|
| complete coverage | 13 seconds |
| control | 2 minutes |
| complete extinguishment | 3 minutes, 48 seconds |
| sealability | still good after 14 minutes |

The expansion, sealability and drainage time of the foam are further improved by adding to the formulation an amount of protein hydrolyzate totalling only about 10% by weight of the Example II resin. Larger additions of the protein hydrolyzate make the formulation essentially undistinguishable from a resin-free protein hydrolyzate formulation.

Another formulation uses the amidated resin of Example II in effectively replacing the protein hydrolyzate for producing a fire-fighting composition described in U.S. Pat. No. 3,475,333, and is made by adding to the formulation of Example III 24 grams of $(CF_3)_2CF(CF_2)_nCOO^-{+}NH_3C_2H_5$
where 20% of the $n$ is 2,
30% of the $n$ is 4,
30% of the $n$ is 6, and
20% of the $n$ is 8.
This formulation is particularly desirable for making a foam that is introduced into a body of burning gasoline in a tank, by injecting the foam below the surface of that gasoline.

Still another use for such amidated resins is in replacing part or all of the fluorine-free surfactants in aqueous film-forming fire-fighting foam compositions described in U.S. Pat. No. 3,562,156. Thus the formula described at the bottom of its column 11 is modified in that the fluorinated amine oxide and the Renex 31 together with the 67 parts water are replaced by 67.5 parts of a 30% solution of the resin of Example II so that the formulation becomes:

EXAMPLE IV

| | | |
|---|---|---|
| $C_6F_{13}SO_2NH\ C_3H_6N\ (CH_3)_2$ | 2.0 | parts |
| Butyl carbitol | 25.0 | parts |
| Acetic acid | 1.5 | parts |
| Crude solution (30% by weight) of Example II resin in water | 67.5 | parts |

In the formulation of Example IV the Example II resin is used without the heavy metal salts generally added to protein hydrolyzate to stiffen the foam and improve its fire-fighting action. The resin appears to behave like protein hydrolyzate because of the 9-carbon hydrocarbon block that can be considered connected to the carboxyl or carboxamide groups. Adding to the Example II resin 1 to 10% by weight of other materials present in protein hydrolyzate, thioglycolic acid for instance, makes it even more closely resemble protein hydrolyzate in its fire-fighting properties, both with and without the heavy metal salts.

The thixotropic ingredient of Example I is scleroglucan. This is an essentially linear polysaccharide which is a polymeric form of glucose with a degree of polymerization of from about 100 to 1600 glucoses per molecule and its production and other characteristics are described in U.S. Pat. No. 3,301,848 granted January 31, 1967. One commercial form in which it is sold is the crude dried residue of the fermentation of *sclerotium glucanicum* in aqueous glucose containing corn steep liquor and the usual mineral salts including nitrate, and this form can be used in place of the purified product in equivalent amounts. The scleroglucan of this crude material can be recovered from the fermentation mixture with the help of a shearing action as described in U.S. Pat. No. 3,436,311 granted Apr. 1, 1969, and may then have a degree of polymerization in the lower portion of the foregoing range. It is preferred to have a degree of polymerization at least as high as 120 for the purposes of the present invention.

The thixotropic material is used in a concentration that causes the diluted fire-fighting liquid to rapidly gel when applied to a polar or water-miscible liquid. For the scleroglucan this concentration can range from about 0.1% to about 0.3% by weight of the foam-forming diluted liquid, or 1 to 3% of the concentrate. Larger amounts can be used in the diluted liquid, but are more difficult to dissolve in the concentrate.

Another thixotropic material that can be used pursuant to the present invention is xanthan gum. This is also an essentially linear polysaccharide with a molecular weight of about 1 to about 20 million, and along with its method of preparation is described in "Gum Technology in the Food Industry" by Martin Glicksman published 1969 by Academic Press, pages 341–47. Other suitable thixotropic essentially linear polysaccharides are the phosphomannan Y-2448 described on pages 350–53, and polysaccharide Y-1401 described on pages 353–56 of the same text. There is available from Kelco Co., Clark, N.J., under the name KELZAN a fermentation-derived water-soluble thixotropic polysaccharide that is also suitable for the present invention. Any water-soluble thixotropic polysaccharide having at least 100 glycose units, or a molecular weight of at least about 18,000 seems to provide the gelling action of the present invention when used in the foregoing formulation, although scleroglucan is preferred. Xanthan gum for example is best used in a concentration about 10% higher than scleroglucan.

Locust bean gum, or carob-seed gum as it is sometimes called, is a polysaccharide (essentially galactomannan having a molecular weight of about 310,000) that is not generally considered thixotropic, but it helps increase the thixotropic effectiveness of thixotropic polysaccharides. Thus mixing any of the thixotropic polysaccharides with an equal weight of locust bean gum makes it possible to use the mixture in a quantity about 20% less than the thixotropic polysaccharide when used without the locust bean gum.

Advantages are obtained when the amount of locust bean gum varies from about one-third to about three times that of the thixotropic polysaccharide in any formulation.

The imidazoline and alkyl sulfate surfactants of Example I are foaming agents that provide particularly good foams. Even better results can be obtained by doubling the amount of imidazoline surfactant of Example I and eliminating the alkyl sulfate surfactant. However any surfactant or mixture of surfactants used to prepare fire-fighting foam can also be used in the thixotropic compositions of the present invention. Those particularly desirable for fighting fires on hydrophobic liquids have hydrophilic and lipophilic moieties of which the hydrophilic moiety weighs at least 80% more than the lipophile moiety, but they need only comprise about one-third or more of the total auxiliary foaming agent surfactant. On the other hand, for fighting fires on hydrophilic liquids nothing is sacrificed by having none of the surfactant of that particularly desirable type. Thus a combination of 1 part by weight disodium dodecylamine dipropionate with 2 parts by weight of sodium octyl sulfate, or corresponding combinations of disodium cocoamine dipropionate and mixed sodium octyl and decyl sulfates are quite effective when substituted in the formulation of Example I. Still other good foaming agents are referred to in U.S. Pat. Nos. 3,186,943, 3,422,011 and 3,479,285.

The N-methyl pyrrolidone-2 is a particularly desirable ingredient in the formulation of Example I inasmuch as it provides a concentrate of greater fluidity and less viscosity than one in which water is used in its place. An N-methyl pyrrolidone-2 concentrtion of from about one-half to about 2 times the water concentration by weight, or from about 25 to about 60% of the total concentrate by weight gives good results and makes it easier for the concentrate to be sucked into a dip tube of a mixing venturi. However foam-forming concentrates can be pumped with positive pressures directly applied to them and for such purposes the N-methyl pyrrolidone-2 is not needed.

The freezing point of the concentrate is also reduced by the N-methyl pyrrolidone-2. If this antifreeze action is not available, then other antifreeze additions, such as an increase in glycol content, can be made inasmuch as the concentrate may have to be used after standing for long periods at ambient temperatures as low as −20° C, and should not be permitted to freeze at that temperature. The concentrate does not freeze through very rapidly when all the N-methyl pyrrolidone-2 is removed so long as it remains in gelled condition. This slow freezing is due to the lack of convection currents in the gel.

The amount of scleroglucan in the above-formulated concentrate can be further reduced by suspending some bentonite or other siliceous thickening agent in the concentrate. Thus the addition of 1% bentonite based on the total weight of the concentrate can be accompanied by a lowering of the scleroglucan quantity to 1%. From about one-half to 2% bentonite or other siliceous thickening agent can be added.

It is also helpful to buffer the concentrate as by the addition of some tris-hydroxymethyl aminomethane in a quantity of one-eighth to one-half % by weight, unless the silicone surfactant is omitted.

Obviously many modifications and variations of the present invention are possible in the light of the above teachings. It is, therefore, to be understood that within the scope of the appended claims the invention may be practiced otherwise than as specifically described.

What is claimed:

1. In the method of fighting a fire on a burning liquid with a single fire-fighting concentrate by highly diluting the concentrate with water, foaming the diluate, and applying the foamed diluate to the burning liquid to blanket and thus extinguish the burning, the improvement according to which the burning liquid is a hydrophilic liquid and the concentrate contains a dissolved thixotropic polysaccharide in an amount that causes the foamed diluate to gel upon contact with the hydrophilic liquid and lose some of its water to the hydrophilic liquid to form a foamed mat that does not dissolve in the hydrophilic liquid rapidly enough to significantly diminish the blanketing action of the foam.

2. The improvement of claim 1 in which the polysaccharide is scleroglucan and is present in the diluate in a concentration from about 0.1 to about 0.3% by weight.

3. In the method of fighting a fire on a burning liquid with a single fire-fighting concentrate that contains a foam-stabilizing hydrophilic resin by highly diluting the concentrate with water, foaming the diluate, and applying the foamed diluate to the burning liquid to blanket and thus extinguish the burning, the improvement according to which the burning liquid is a hydrophilic liquid and the concentrate contains a dissolved thixotropic polysaccharide in an amount that causes the foamed diluate to gel upon contact with the hydrophilic liquid and lose some of its water to the hydrophilic liquid to form a foamed mat that does not dissolve in the hydrophilic liquid rapidly enough to significantly diminish the blanketing action of the foam.

4. The improvement of claim 3 in which the resin is a film-forming polymeric material having repeating phenylethylene units and repeating units of a half amide of succinic acid with 3-dimethylamino propylamine, there being from about one-half to 5 phenylethylene units for every succinic acid unit.

* * * * *